US007135946B2

(12) United States Patent
Hoffmann

(10) Patent No.: US 7,135,946 B2
(45) Date of Patent: Nov. 14, 2006

(54) ELECTROMAGNETIC RELAY HAVING AT LEAST ONE RELAY ACTUATOR AND A RECEPTACLE FOR RELAY ACTUATORS

(75) Inventor: Ralf Hoffmann, Berlin (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 11/049,841

(22) Filed: Feb. 3, 2005

(65) Prior Publication Data

US 2005/0231312 A1 Oct. 20, 2005

(30) Foreign Application Priority Data

Feb. 3, 2004 (EP) ..... 04002352

(51) Int. Cl.
*H01H 51/22* (2006.01)
*H01H 9/00* (2006.01)

(52) U.S. Cl. ..... 335/78; 335/83; 335/159

(58) Field of Classification Search ..... 335/78–83, 335/128, 159
See application file for complete search history.

(56) References Cited

U.S. PATENT DOCUMENTS 4,816,794 A * 3/1989 Nagao et al. ..... 335/136
4,959,627 A * 9/1990 Iizumi et al. ..... 335/106
5,126,709 A * 6/1992 Tanaka et al. ..... 335/80
5,274,348 A * 12/1993 Vernier et al. ..... 335/78
6,337,614 B1 * 1/2002 Tsutsui ..... 335/160
6,414,576 B1 * 7/2002 Nakamura et al. ..... 335/83
6,686,821 B1 * 2/2004 Suzuki ..... 335/128

FOREIGN PATENT DOCUMENTS

DE 199 17 338 C2 2/2001
DE 103 04 638 A1 10/2003

* cited by examiner

*Primary Examiner*—Ramon M. Barrera
(74) *Attorney, Agent, or Firm*—Barley Snyder LLC

(57) ABSTRACT

A double relay is described which has two relay actuators which are inserted into a common receptacle. Each relay actuator has a first fixed contact and a movable contact. Arranged on the receptacle are two second fixed contacts, in each case a second fixed contact being associated with a movable contact of a relay actuator. The receptacle has a plurality of connection pins by way of which an electrical contact may be made with the relay actuators and the second fixed contacts. The double relay can be manufactured at low cost.

12 Claims, 4 Drawing Sheets

ELECTROMAGNETIC RELAY HAVING AT LEAST ONE RELAY ACTUATOR AND A RECEPTACLE FOR RELAY ACTUATORS

FIELD OF THE INVENTION

The invention relates to an electromagnetic relay having a relay actuator with a fixed contact and a movable contact which is mounted on an armature spring with terminals in electrically conductive connection with the fixed contact and the movable contact, and a receptacle for receiving at least one relay actuator.

BACKGROUND OF THE INVENTION

A wide variety of constructions are known for electromagnetic relays. For example, electromagnetic relays are used in automotive technology to create different switching states for the electrical lines of a motor vehicle. Relays have, for example, one or two relay actuators which are accommodated in a housing.

DE 199 17 338 C2 discloses an electromagnetic relay and a process for manufacturing the relay, in which the electromagnetic relay has a base having an electromagnet system and a coil, a core arrangement and an armature. The armature is mounted on the base by way of an armature spring. The base forms part of a switching chamber. Arranged in the switching chamber is a contact system having at least one fixed contact. Associated with the fixed contact is a movable contact which is mounted on the movable armature spring. Furthermore, a second fixed contact is arranged on the base. The movable contact is switched between the two fixed contacts as a function of the current passing through the coil of the first electromagnetic relay. The electromagnet system and the switching chamber are arranged in a housing, with the fixed parts of the electromagnet system and at least some of the base being embedded in an insulating material, with terminal conductors guided through a housing wall to the outside.

DE 103 04 638 A1 discloses a switching relay having two magnetic coils and a process for manufacturing the switching relay. The switching relay has two relay actuators which are arranged parallel to one another and whereof the armature springs are associated with one another and are brought into abutment against a first or a second fixed contact in a central region between the magnetic coils as a function of the current passing through the magnetic coils.

SUMMARY OF THE INVENTION

According to an exemplary embodiment of the invention, an electromagnetic relay is provided, comprising a receptacle and a first relay actuator mounted on the receptacle. The first relay actuator has a first contact and a movable contact, the movable contact being mounted on an armature spring having an armature. The first relay actuator has a first and a second terminal, with the first terminal being in electrically conductive connection with the first contact and the second terminal being in electrically conductive connection with the movable contact. The receptacle has electrical connection pins in contact with electrical terminals of the first relay actuator, a second contact secured to the receptacle and associated with the movable contact, and a further connection pin which is in electrically conductive connection with the second contact. The armature spring brings the movable contact into abutment against either the first or the second contact as a function of the current passing through the relay actuator.

One advantage of the relay according to this embodiment consists in the fact that the relay has a relay actuator which is mounted in a receptacle, with a first fixed contact being constructed on the relay actuator and a second fixed contact being constructed on the receptacle. The receptacle has at least one connection pin which serves to make electrical contact with the second contact, which is mounted on the receptacle in fixed manner.

The arrangement of the second contact on the receptacle makes possible a simple construction for the relay actuator, which is mounted on the receptacle in order to produce the electromagnetic relay. This embodiment makes possible a compact construction of the electromagnetic relay, which can make an electrically conductive connection between one of the two contacts.

In a further preferred embodiment, a second relay actuator is mounted on the receptacle, constructed substantially in the same way as the first relay actuator. Moreover, a further second contact is mounted on the receptacle and represents the second fixed contact for the second relay actuator. The arrangement of two relay actuators which are substantially identical in construction means that a low-cost construction of a relay having improved functionality is provided.

In a further preferred embodiment, the second and/or the further second contact of the receptacle are each in electrically conductive connection with a connection pin of the receptacle. In this way, a secure contact is made for the second and the further second contact respectively.

In a further preferred embodiment, the receptacle has a recess into which one end of the iron core of the relay actuator is inserted. Adjoining the recess there is embedded in the receptacle a contact face which is connected to the iron core preferably by way of a laser weld. The contact face is moreover in electrically conductive connection with a connection pin which is embedded in the receptacle. In this way, a simple construction and reliable mounting of the relay actuator in the receptacle are made possible.

In a further preferred embodiment, a second recess is made in the receptacle, symmetrically in relation to the first recess, and in similar manner the armature spring of the second relay actuator is brought into electrically conductive contact with a second contact face by way of the iron core in this recess. In this way, a simple and reliable electrically conductive contact can be made for the armature springs of the first and the second relay actuators by way of a common contact element.

Preferably, the respective first contact of the first and/or the second relay actuator is electrically conductively connected to a connection pin by way of a contact element embedded in the receptacle.

In a further preferred embodiment, the first and/or the second relay actuator has/have at least one contact pin which is electrically conductively connected to the first contact or the armature spring, with the contact pin being guided through an opening in the receptacle. In this way, a direct electrical contact is made between the contact pin and the relay actuator without a connection pin for the receptacle.

In another exemplary embodiment of the invention, a receptacle is provided for two relay actuators. The receptacle is made from an insulating material, with two fixed contacts embedded in the receptacle. The two fixed contacts are provided as mating contacts for movable contacts of the relay actuators. The fixed contacts are in electrically conductive connection with a connection pin. A contact element embedded in the receptacle is configured to make electrically conductive contact with the two fixed contacts of the two relay actuators, the contact element being in electrically conductive connection with a connection pin. Electrical terminals are embedded in the receptacle for supplying power to coils of the relay actuators.

One advantage of the receptacle according to the invention consists in the provision of a simple, low-cost and reliable mounting for two relay actuators. This advantage is achieved in that two fixed contacts are embedded in the receptacle, in that the two fixed contacts are provided as mating contacts for movable contacts of the relay actuators, in that the fixed contacts are electrically conductively connected to a connection pin, in that there is embedded in the receptacle a contact element which is constructed to make electrically conductive contact with the two fixed contacts of the two relay actuators, in that the contact element is electrically conductively connected to a connection pin, and in that electrical terminals for supplying power to coils of the relay actuators are embedded in the receptacle.

BRIEF DESCRIPTION OF THE DRAWINGS

The invention will be explained in more detail below with reference to the figures, in which.

DETAILED DESCRIPTION OF THE EMBODIMENT(S)

Figure 1:
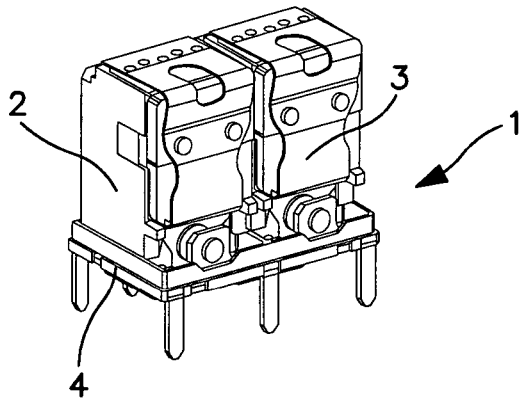
FIG. 1 shows a receptacle plate having two relay actuators according to an embodiment of the invention.

FIG. 1 shows a receptacle in the form of a receptacle plate 4 onto which a first and a second relay actuator 2, 3 are pushed. In the embodiment illustrated, the first and the second relay actuator 2, 3 are identical in construction and arranged parallel next to one another, with armature springs 10 (shown in FIG. 2) of the relay actuators 2, 3 being arranged next to one another on one contact side of the receptacle plate 4. The relay 1 illustrated in FIG. 1 represents a double relay illustrated without a protective cap. In the final condition, the first and the second relay actuators 2, 3 are covered by way of a protective cap which is pushed onto the receptacle plate 4. The receptacle plate 4 is made substantially from an insulating material in which electrical conductors are embedded. For the purpose of connection, the receptacle has connection pins which serve both to connect the power supply to the relay actuators 2, 3 and to connect those contacts of the relay actuators 1, 2 which have to be switched.

Figure 2:
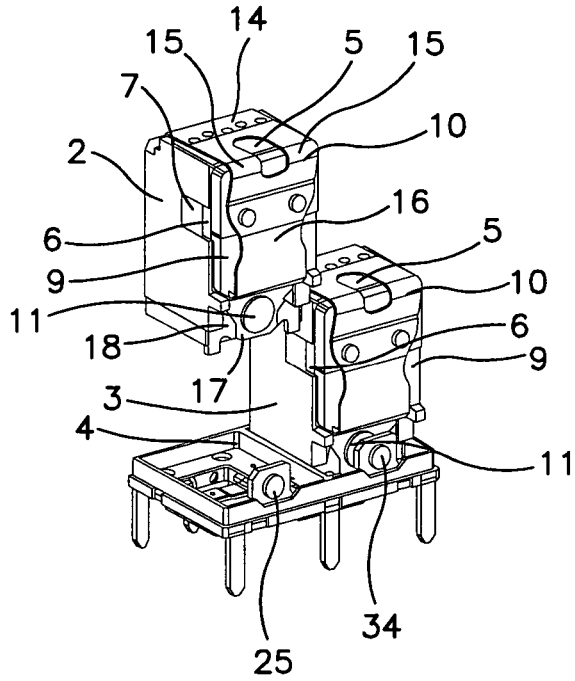
FIG. 2 shows the receptacle plate of FIG. 1 having an inserted relay actuator and a second relay actuator illustrated above the insertion position.

FIG. 2 shows the receptacle plate 4, with the first relay actuator 2 not yet inserted into the receptacle plate 4. The first relay actuator 2 has a coil 7 with an iron core 5, a lower end thereof being inserted into a pole piece 6. The pole piece 6 extends as far as a contact side of the first relay actuator 2. Arranged in front of the pole piece 6 is an armature plate 9 which is mounted in resilient manner on the first relay actuator 2 by way of an armature spring 10. The armature spring 10 has a terminal face 14 which is secured to an upper end face of the first relay actuator 2. The terminal face 14 merges by way of two bent flexible arms 15 into a holding face 16, which is arranged parallel to the contact side of the first relay actuator 2 and substantially perpendicular to the terminal face 14. Secured to the holding face 16 on an inner side is the armature plate 9, which is associated with the pole piece 6. The holding face 16 extends downwards beyond the armature plate 9 and has a contact face 17 to which a contact rivet 11 is secured. The contact rivet 11 has a contact face on either side of the contact face 17 of the armature spring 10. Associated with the inside of the contact face 17 is a first fixed contact 18 which is secured to the first relay actuator 2. The contact rivet 11 represents a movable contact.

Figure 3:
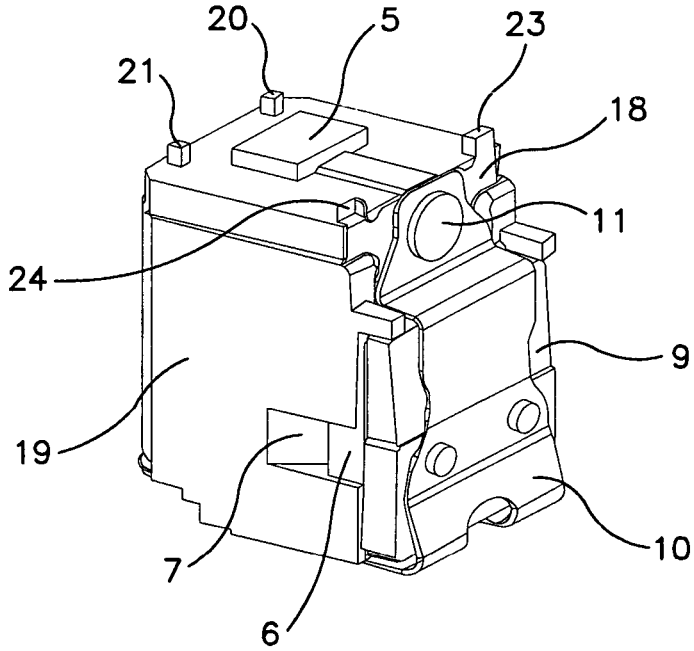
FIG. 3 shows a relay actuator in a perspective illustration according to an embodiment of the invention.

FIG. 3 shows a perspective illustration of the first relay actuator 2, in a view from below of the first fixed contact 18. The coil 7, the pole piece 6 and the iron core 5 are embedded in an insulating material 19. Projecting out of the underside of the first relay actuator 2 are a first and a second terminal pin 20, 21. The first and the second terminal pins 20, 21 are connected electrically conductively to the winding of the coil 7 of the first relay actuator 2. The first fixed contact 18 is constructed in the form of a contact plate with a second contact rivet (not shown) arranged on the outer side thereof. The second contact rivet is arranged at the same height as the first contact rivet 11 of the armature spring 10. The first fixed contact 18 has two projecting contact pins 23, 24 which serve to make electrical contact with the first fixed contact 18. Instead of the second contact rivet, another type of contact piece may also be provided.

Figure 4:
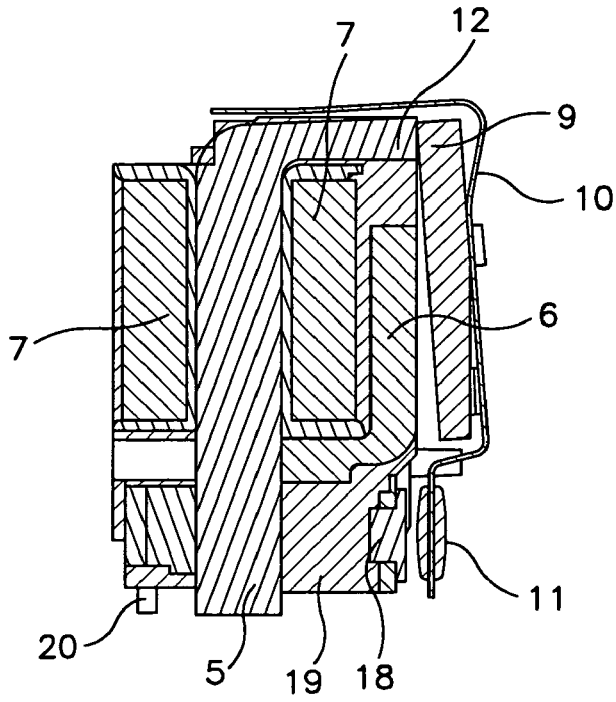
FIG. 4 shows a cross-section through the relay actuator of FIG. 3.

FIG. 4 shows a cross-section through the first relay actuator 2. The iron core 5 passes through the cavity in the coil 7 and, in an upper end region, is constructed to be in one piece with a yoke 12 on the front side whereof an end region of the armature plate 9 bears. The armature plate 9 is mounted on the armature spring 10 and extends from the yoke 12 into a region above the pole piece 6. The pole piece 6 is magnetically coupled to the iron core 5 and extends as far as the contact side of the first relay actuator 2. The armature spring 10 extends with the contact face 17 into the region in which the first fixed contact 18 is arranged on the first relay actuator 2. Opposite the first fixed contact 18 there is constructed a second fixed contact 25 which is mounted on the receptacle plate 4 (FIG. 2). As a function of the current passing through the coil 7, the contact rivet 11 is either brought into contact with the first fixed contact 18 or with the second fixed contact 25. In this way, an electrically conductive connection is made between the iron core 5 and the first fixed contact 18 or between the iron core 5 and the second fixed contact 25. The first and the second relay actuators 2, 3 are preferably identical in construction.

Figure 5:
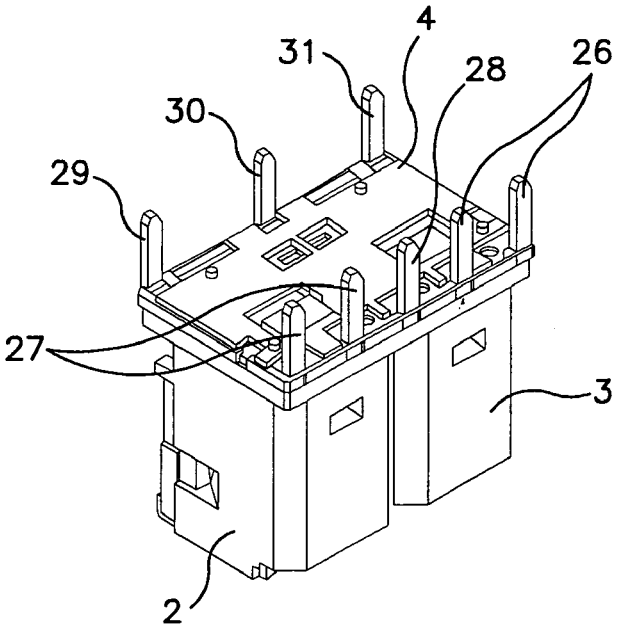
FIG. 5 shows a bottom view of a receptacle plate with two relay actuators inserted.

FIG. 5 shows the relay 1 from below, with the receptacle plate 4 having first and second connection pins 26, 27 for supplying electrical power to the coils 7 of the first and second relay actuators 2, 3. A third connection pin 28 is embedded in the receptacle plate 4 and is connected electrically conductively to the first fixed contact 18 of the first and second relay actuators 2, 3. Further provided in a first corner region is a fourth connection pin 29 which is connected electrically conductively to the iron core 5 of the first relay actuator 2. At an opposite corner region, a fifth connection pin 31 is embedded in the receptacle plate 4 and connected electrically conductively to the iron core 5 of the second relay actuator 3. Between the fourth and the fifth connection pin 29, 31 there is arranged a sixth connection pin 30 which is connected electrically conductively to the second fixed contact 25 and the further second fixed contact 34 of the receptacle plate 4. The second fixed contact 25 is associated with the first relay actuator 2 and the further second fixed contact 34 is associated with the second relay actuator 3.

Figure 6:
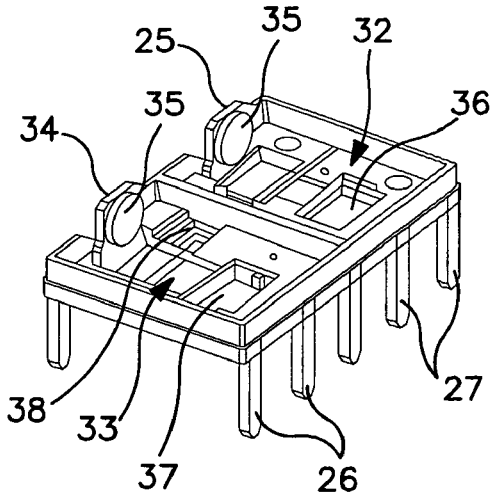
FIG. 6 shows a top view of the receptacle plate of FIG. 1 in a perspective illustration.
Figure 7:
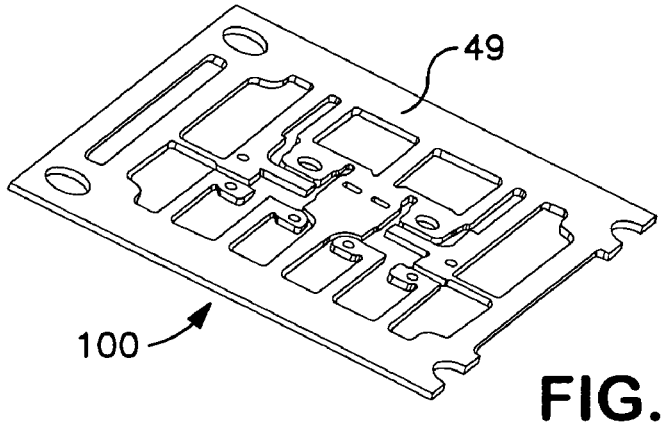
FIG. 7 shows a first process step during manufacture of a receptacle plate according to an embodiment of the invention.
Figure 8:
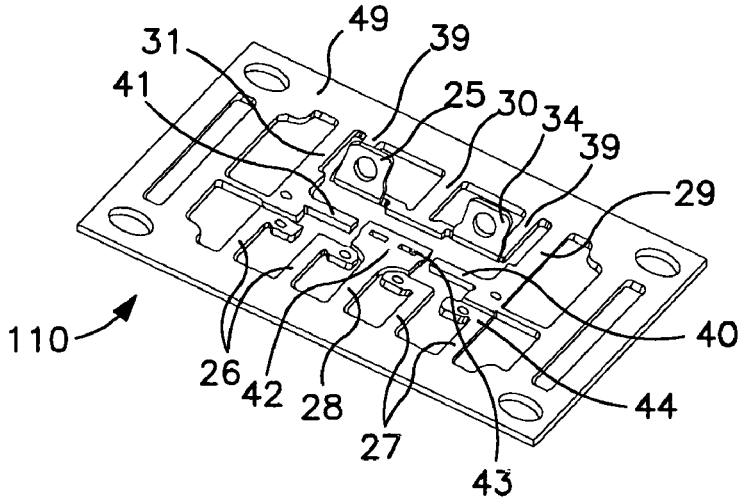
FIG. 8 shows a second process step during manufacture of the receptacle plate.

FIG. 6 shows a perspective illustration of the receptacle plate 4 from above, with a first receiving region 32 being provided for the first relay actuator 2 and a second receiving region 33 being provided for the second relay actuator 3. The first and the second receiving regions 32, 33 are formed substantially by a three-sided frame. In each receiving region 32, 33 there is constructed a second fixed contact 25, 34 on the contact side of the receptacle plate 4. The second fixed contact 25 and the further second fixed contact 34 are connected electrically conductively to the sixth connection pin 30. The second fixed contact 25 and the further second fixed contact 34 each have, on an inner side, a further contact rivet 35. A first and a second recess 36, 37 are made in the base region of the first and the second receiving regions 32, 33 respectively. The first and the second recesses 36, 37 serve to receive end regions of the iron cores 5 of the first and second relay actuators 2, 3.

In a preferred embodiment, respective openings 38 are made in the comer regions of the receptacle plate 4 in the first and the second receiving regions 32, 33 to receive the first and the second terminal pins 20, 21. Moreover, two openings 38 are provided in the receptacle plate 4 into which the first or the second contact pin 23, 24 may respectively be inserted for a relay actuator. In this embodiment, one of the two contact pins 23, 24 of a relay actuator is pinched off beforehand or indeed never provided. In a further embodiment, it is also possible for two openings to be provided respectively for the first and the second contact pin 23, 24. The first and the second terminal pins 20, 21 and the first and/or the second contact pin 23, 24 are connected to the corresponding connection pins in electrically conductive manner by way of the openings 38.

FIGS. 7 to 11 show different process steps by way of which manufacture of the receptacle plate 4 will be explained. In a first process step 100, illustrated in FIG. 7, appropriate contact parts are punched out of a lead frame 49. In a second process step 110, illustrated in FIG. 8, the contact parts for the second and the further second fixed contacts 25, 34 are bent upwards in the end region. The second and the further second fixed contact 25, 34 are mounted on the lead frame 49 by way of a respective holding web 39 and a central sixth connection pin 30. The fourth connection pin 29 and the fifth connection pin 31 are respectively arranged laterally in respect of the second fixed contact 25 and the further second fixed contact 34 and lead laterally past the second fixed contact 25 and the further second fixed contact 34 and are constructed to have a contact face 40, 41 towards the inside. Between the first and the second contact face 40, 41 a contact element 42 projects from the opposite side of the lead frame 49 almost as far as the second and the further second fixed contact 25, 34. The contact element 42 has two contact openings 43. The two contact openings 43 serve to receive, respectively, the first contact pin 23 of the first and the second relay actuators 2, 3. Furthermore, two first connection pins 26 and two second connection pins 27, which each have a third contact face 44, are provided.

Figure 9:
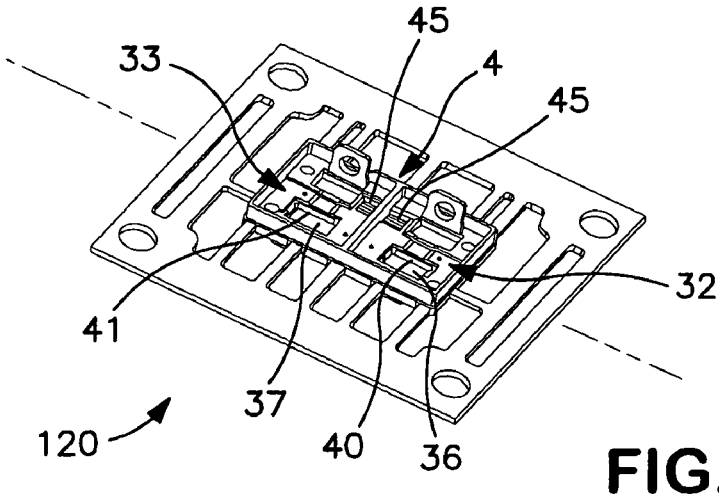
FIG. 9 shows a third process step during manufacture of the receptacle plate.

In a third process step 120 illustrated in FIG. 9, the receptacle plate 4 is made by an injection moulding process. For this, the receptacle plate 4 is made from an electrically insulating material, during which the first and the second receiving regions 32, 33 are constructed. A first and a second recess 36, 37 are made in the first and the second receiving regions 32, 33. The first and the second contact faces 40, 41 adjoin the first and the second recess 36, 37 respectively. Moreover, two further contact openings 45 are made in the base plate of the receptacle plate 4 above the contact openings 43 of the contact element 42. The two further contact openings 45 serve to introduce and make contact with a first and a second contact pin 23, 24 of the fixed contacts 18 of two relay actuators 2, 3. The respectively other contact pin 23, 24 of the fixed contacts, for which no further contact opening 45 is provided, is pinched off or indeed never provided when the relay actuator is manufactured, in that the fixed contact 18 of one relay actuator 2, 3 has only a first or a second contact pin 23, 24.

Figure 10:
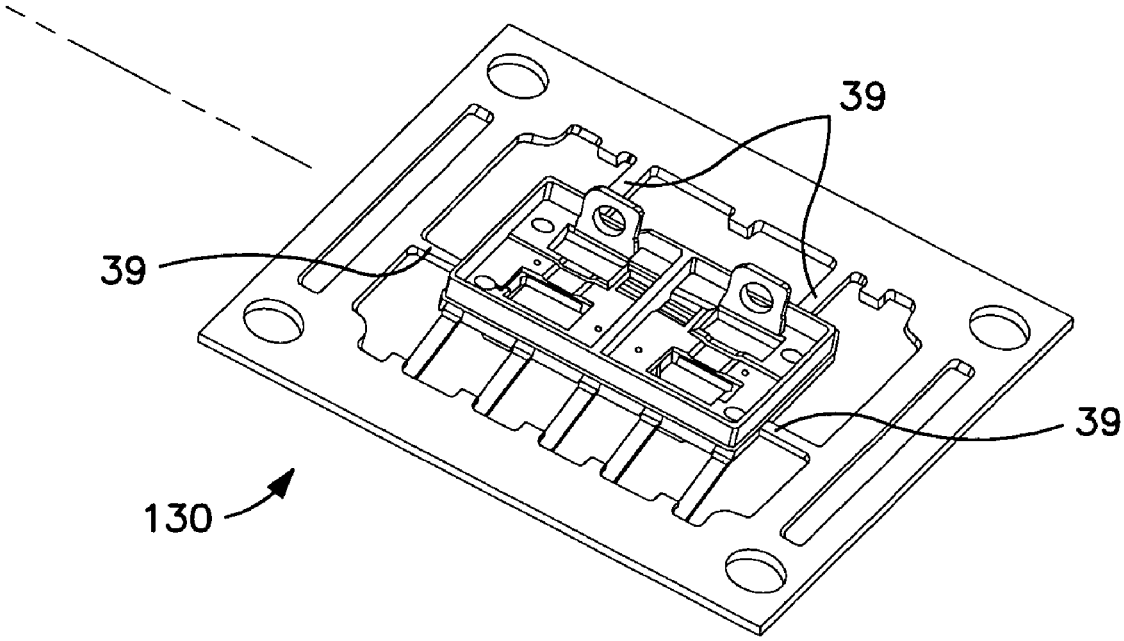
FIG. 10 shows a fourth process step during manufacture of the receptacle plate.

Then, in a fourth process step 130 illustrated in FIG. 10, the terminal pins are separated from the lead frame 49, so that the receptacle plate 4 is only mounted on the lead frame by way of holding webs 39.

Then the holding webs 39 are removed. Thereupon, and as illustrated in FIG. 2, the first and the second relay actuators 2, 3 are inserted into the receptacle plate 4. On insertion the electrically conductive contacts are made between the iron cores 5, the first and the second terminal pins 20, 21 and the first and the second contact pins 23, 24 of the first and the second relay actuator 2, 3 and the associated connection pins. In addition, the iron cores 5, the first and the second terminal pins 20, 21 and the first and/or the second contact pins 23, 24 of the first and the second relay actuator 2, 3 are welded to the receptacle plate 4, preferably by means of a laser. The relay actuators 1, 2 are moreover preferably mounted in the receptacle plate 4 by way of an adhesive connection.

Figure 11:
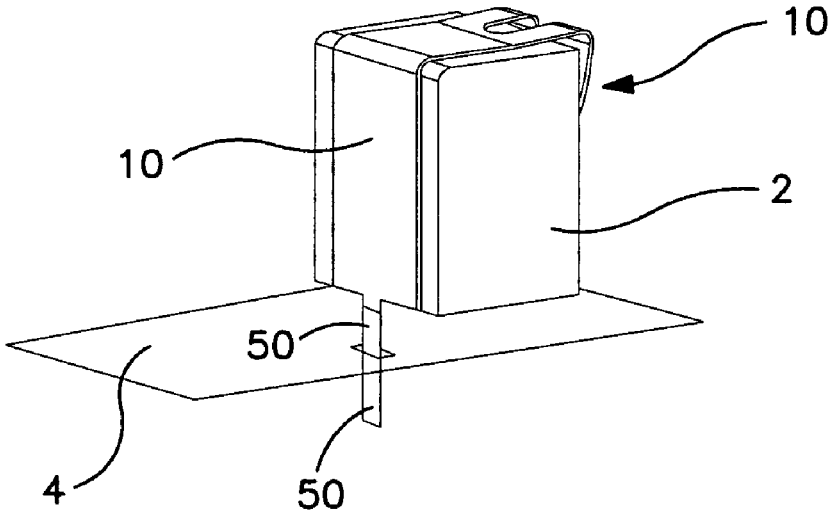
FIG. 11 shows a relay actuator with a terminal pin for making electrical contact with the armature spring according to an embodiment of the invention.

FIG. 11 shows a further embodiment of a relay actuator in which the armature spring 10 extends downwards over the rear side of the relay actuator 2 and merges into an armature spring pin 50. This means that in this embodiment the armature spring 10 does not make electrically conductive contact by way of a connection pin of the receptacle plate 4 but directly by way of the armature spring pin 50. For this purpose, the armature spring pin 50 is guided through a pin opening in the receptacle plate 4, as illustrated in FIG. 11. In this embodiment, the fourth and the fifth connection pins 29, 31 of the receptacle plate 4 can thus be dispensed with.

What is claimed is:

1. An electromagnetic relay, comprising:

a receptacle; and a first relay actuator mounted on the receptacle, the first relay actuator having a first contact and a movable contact, the movable contact being mounted on an armature spring having an armature, the first relay actuator having a first and a second terminal, with the first terminal being in electrically conductive connection with the first contact and the second terminal being in electrically conductive connection with the movable contact;

the receptacle having electrical connection pins in contact with electrical terminals of the first relay actuator, a second contact secured to the receptacle and associated with the movable contact, and a further connection pin which is in electrically conductive connection with the second contact;

wherein the armature spring brings the movable contact into abutment against either the first or the second contact as a function of the current passing through the relay actuator and wherein the receptacle has a recess into which one end of the iron core of the first relay actuator is inserted, and a contact face is embedded in the receptacle adjoining the recess and makes an electrical contact between a connection pin and the iron core of the first relay actuator, with the iron core being in electrically conductive connection with the movable contact of the first relay actuator by way of the armature spring.

2. A relay according to claim 1, wherein the receptacle has a second recess into which an end of an iron core of the second relay actuator is inserted, a second contact face being is embedded in the receptacle adjoining the second recess and making electrically conductive contact with the iron core of the second relay actuator, the iron core being in electrically conductive connection with the movable contact of the second relay actuator by way of the armature spring, the second contact face being connected to a connection pin.

3. A relay according claim 1, wherein the relay actuator has an armature spring pin which is in electrically conductive connection with the armature spring, and in that the armature spring pin is pushed through a pin opening in the receptacle and serves as a terminal pin.

4. A relay according to claim 1, wherein a second relay actuator is mounted on the receptacle, the second relay actuator being substantially the same as the first relay actuator, the receptacle having a further second contact associated with a movable contact of the second relay actuator.

5. A relay according to claim 4, wherein the further second contact is in electrically conductive connection with the further connection pin of the receptacle.

6. A relay according to claim 4, wherein the second contact and the further second contact are each in electrically conductive connection with one another in the receptacle, and the contact pins of the first contacts of the first and second relay actuators are in electrically conductive connection with one another in the receptacle.

7. A relay according to claim 6, wherein a contact element is embedded in the receptacle and is in electrically conductive connection with the first contact of the first or the second relay actuator, and the contact element is in electrically conductive connection with a connection pin.

8. A relay according claim 4, wherein the receptacle further comprises electrical terminals embedded in the receptacle for supplying power to coils of the relay actuators.

9. A relay according to claim 8, wherein two contact faces are embedded in the receptacle and are electrically insulated from one another, each contact face being provided for making electrical contact with the movable contact of the relay actuator, and each contact face being in electrically conductive connection with a connection pin.

10. A relay according to claim 8, wherein two recesses are made in the receptacle, each recess being configured to receive an iron core of the relay actuator.

11. A receptacle according to claim 10, wherein a respective contact face adjoins each recess and is configured to make electrical contact with the respective iron core and the armature spring in electrically conductive connection therewith.

12. A receptacle according to claims 8, wherein two further contact openings are provided in the receptacle above a contact element for making electrical contact with the fixed contacts of the two relay actuators for introducing a contact pin of the fixed contacts of the two relay actuators.

* * * * *